US006263969B1

(12) United States Patent
Stoesz et al.

(10) Patent No.: US 6,263,969 B1
(45) Date of Patent: Jul. 24, 2001

(54) BYPASS SUB

(75) Inventors: Carl W. Stoesz, Katy; Gary E. Cooper, Conroe, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/366,837

(22) Filed: Aug. 4, 1999

Related U.S. Application Data

(60) Provisional application No. 60/096,441, filed on Aug. 13, 1998.

(51) Int. Cl.[7] ..... E21B 34/08

(52) U.S. Cl. ..... 166/334.4; 166/321; 137/115.08

(58) Field of Search ..... 166/321, 324, 166/332.7, 334.4, 332.1; 137/115.08, 115.03, 115.09

(56) References Cited

U.S. PATENT DOCUMENTS

| | | | |
|---|---|---|---|
| 3,025,919 | 3/1962 | Angel et al. | 175/317 |
| 3,802,515 | 4/1974 | Flamand et al. | 173/12 |
| 3,989,114 | 11/1976 | Tschirky et al. | 175/107 |
| 4,275,795 | 6/1981 | Beimgraben et al. | 175/26 |
| 4,768,598 | 9/1988 | Reinhardt | 175/26 |
| 5,890,540 * | 4/1999 | Pia et al. | 166/321 |
| 6,095,249 * | 8/2000 | McGarian et al. | 166/319 |

FOREIGN PATENT DOCUMENTS

| | | |
|---|---|---|
| 2 305 681 | 4/1997 | (GB) . |
| 2 309 470 | 7/1997 | (GB) . |
| 2 314 106 | 12/1997 | (GB) . |
| WO 97/47850 | 12/1997 | (WO) . |

OTHER PUBLICATIONS

Baker Oil Tools catalog, Circulation Control Joint and Pump–Out Sub, pp. 68 & 69, date of publication unknown.
SMF catalog, Dortool Actuated Circulation Sub, p. 30, date of publication unknown.

* cited by examiner

*Primary Examiner*—William Neuder
*Assistant Examiner*—Zakiya Walker
(74) *Attorney, Agent, or Firm*—Gerald W. Spinks

(57) ABSTRACT

A bypass sub which will automatically bypass fluid flow in excess of a selected optimal flow rate for a downhole mud motor. A spring biased mandrel within a housing is driven downwardly by increased fluid flow, and driven upwardly by spring force upon decreased fluid flow, to control the alignment of a port in the mandrel with a bypass port in the housing, thereby maintaining a desired rate of fluid flow to the downhole motor.

13 Claims, 2 Drawing Sheets

BYPASS SUB

CROSS REFERENCE TO RELATED APPLICATIONS

This application claims benefit of U.S. Provisional Patent Application Ser. No. 60/096,441, filed Aug. 13, 1998.

STATEMENT REGARDING FEDERALLY SPONSORED RESEARCH OR DEVELOPMENT

Not Applicable

BACKGROUND OF THE INVENTION

1. Field of the Invention

The primary use of this invention is in the field of equipment used in conjunction with downhole mud motors in the drilling of oil and gas wells.

2. Background Information

In many applications, an oil or gas well is drilled with a fluid driven motor, called a mud motor, which is lowered into the well bore as drilling progresses. The mud motor is affixed to the lower end of a drill pipe. Drilling fluid, or mud, is pumped down through the drill pipe by pumps situated at the surface of the earth, at the drill site. The drilling fluid pumped downhole through the drill pipe passes through the mud motor, turning a rotor within the mud motor. For a given mud motor, there is an optimum mud flow rate, and minimum and maximum allowable mud flow rates. The rotor turns a drive shaft which turns a drill bit, to drill through the downhole formations. Similarly, a milling tool can be affixed to the mud motor, instead of a drill bit, for milling away metal items which may be found downhole. After passing through the mud motor, the drilling fluid, or at least a portion of it, typically passes on through the drill bit or milling tool. After exiting the drill bit or milling tool, the drilling fluid passes back up the well bore, in the annular space around the drill string.

As the drill bit turns and drills through the formation, it grinds, tears, or gouges pieces of the formation loose. These pieces of the formation, called cuttings, can vary in size from powdery particles to large chunks, depending upon the type of formation, the type of drill bit, the weight on bit, and the speed of rotation of the drill bit. Similarly, as a milling tool turns, it removes metal cuttings from the metal item being milled away or milled through. As the drilling fluid exits the drill bit or milling tool, it entrains the cuttings, in order to carry the cuttings back up the annulus of the well bore to the surface of the well site. At the surface, the cuttings are removed from the drilling fluid, which is then recycled downhole.

Depending upon the type of formation, the drilling depth, and many other factors, the drilling fluid used at any given time is designed to satisfy various requirements relative to the well drilling operation. One of the prime requirements which the drilling fluid must satisfy is to keep the cuttings in suspension and carry them to the surface of the well site for disposal. If the cuttings are not efficiently removed from the well bore, the bit or milling tool can become clogged, limiting its effectiveness. Similarly, the well bore annulus can become clogged, preventing further circulation of drilling fluid, or even causing the drill pipe to become stuck. Therefore, the cuttings must flow with the drilling fluid uphole to the surface. Various features of the drilling fluid are chosen so that removal of the cuttings will be insured. The two main features which are selected to insure cutting removal are drilling fluid viscosity and flow rate.

Adequate viscosity can be insured by proper formulation of the drilling fluid. Adequate flow rate is insured by operating the pumps at a sufficiently high speed to circulate drilling fluid through the well at the required volumetric velocity and linear velocity to maintain cuttings in suspension. In some circumstances, the mud flow rate required for cutting removal is higher than the maximum allowed mud flow rate through the mud motor. This can be especially true when the mud motor moves into an enlarged bore hole, where the annulus is significantly enlarged. If the maximum allowed flow rate for the mud motor is exceeded, the mud motor can be damaged. On the other hand, if the mud flow rate falls below the minimum flow rate for the mud motor, drilling is inefficient, and the motor may stall.

In cases where keeping the cuttings in suspension in the bore hole annulus requires a mud flow rate greater than the maximum allowed mud flow rate through the motor, there must be a means for diverting some of the mud flow from the bore of the drill string to the annulus at a point near, but just above, the mud motor. This will prevent exceeding the maximum mud flow rate for the mud motor, while providing an adequate flow rate in the annulus to keep the cuttings in suspension.

Some tools are known for this and similar purposes. Some of the known tools require the pumping of a ball downhole to block a passage in the mud flow path, usually resulting in the shifting of some flow control device downhole to divert drilling fluid to the annulus. Such tools usually suffer from the disadvantage of not being returnable to full flow through the mud motor, in the event that reduced mud flow becomes possible thereafter. Other such tools might employ a fracture disk or other release means, with these release means suffering from the same disadvantage of not being reversible. At least one known tool uses mud pump cycling to move a sleeve up and down through a continuous J-slot to reach a portion of the J-slot which will allow increased longitudinal movement of the sleeve, ultimately resulting in the opening of a bypass outlet to the annulus. This tool suffers from the disadvantage that the operator must have a means of knowing exactly the position of the J-slot pin, in order to initiate bypass flow at the right time. Initiating increased flow when bypass has not been established can damage the mud motor, while operating at low flow when bypass has been established will lead to poor performance or stalling.

Therefore, it is an object of the present invention to provide a tool which will reliably bypass a portion of the drilling fluid to the annulus when a predetermined flow rate is exceeded, and which will close the bypass path when the flow rate falls back below a predetermined level. This will allow the operator to have complete control of the bypass flow by operation of the drilling fluid pumps at selected levels.

BRIEF SUMMARY OF THE INVENTION

The tool of the present invention includes a housing, within which is installed a slidable hollow mandrel. A bypass port is provided in the housing, between the inner bore of the housing and the annular space around the housing. A mandrel port is provided in the mandrel, between the inner bore of the mandrel and its outer surface. The hollow mandrel is biased toward the uphole direction by two springs stacked one upon the other. The uppermost spring has a lower spring constant than the lowermost spring. A nozzle is fixedly mounted in the bore of the hollow mandrel. The tool is affixed to the lower end of a drill string just above a mud motor. Compressible or incompressible fluid pumped down the drill string flows through the tool to the mud motor. As it passes through the tool, the fluid passes through the nozzle and through the hollow mandrel, and then on to the mud motor. The fluid used with the present invention can be either a liquid or a gas.

When the mandrel is in its upwardly biased position, all of the fluid flow passes through the mandrel and on to the mud motor. As the flow rate of the fluid is increased, the force on the nozzle increases, moving the hollow mandrel downwardly in the flow direction, against the bias of the two springs. After the upper spring is compressed, the mandrel acts against the increased resistance of the lower spring. At this time, the mandrel port begins to align with the bypass port in the housing, allowing a portion of the fluid flow to begin flowing into the annulus, bypassing the mud motor. As the flow rate is further increased by speeding up the pumps, the lower spring is further depressed by downward movement of the mandrel, which causes the mandrel port to allow more bypass flow through the bypass port. This maintains the flow rate through the mud motor below the maximum allowed level. If the flow rate is decreased, the mandrel moves upwardly, reducing the amount of the bypass flow and maintaining the mud motor flow rate in the optimal range.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
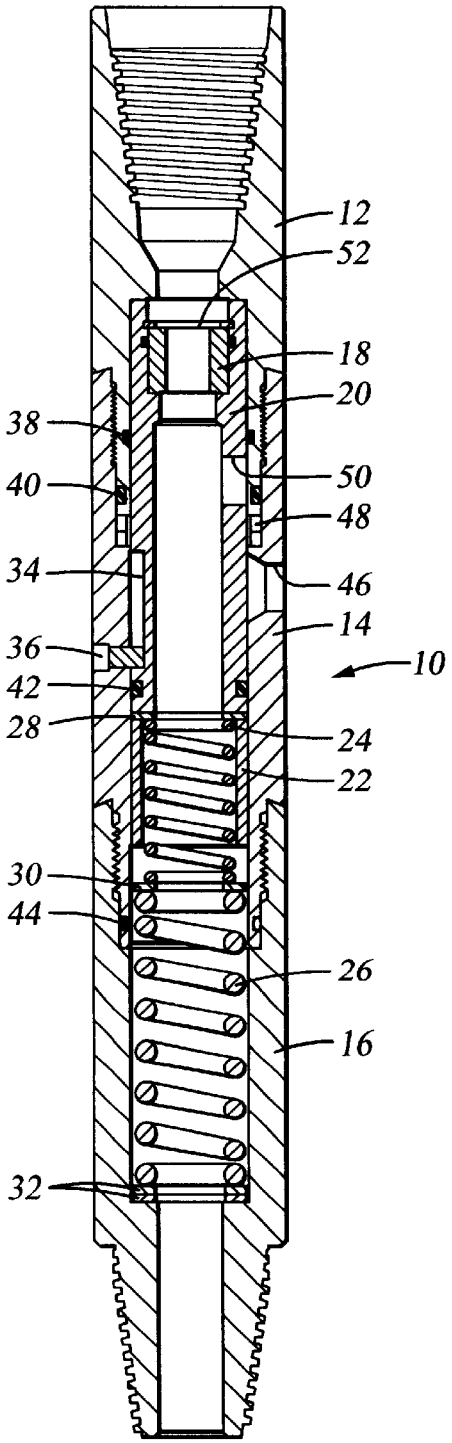
FIG. 1 is a longitudinal section view of the bypass sub of the present invention, showing the tool in the non-bypass configuration.

As shown in FIG. 1, the bypass sub 10 of the present invention includes a top sub 12, which is threaded to an upper housing 14, which is in turn threaded to a lower housing 16. The upper end of the top sub 12 is adapted to be affixed to the lower end of a drill string (not shown), such as by threading. The lower end of the lower housing 16 is adapted to be affixed to the upper end of a mud motor housing (not shown), such as by threading. Fluid which passes through the bypass sub 10 passes through a nozzle 18 which is located in the inner bore of the top sub 12. The nozzle 18 is fixedly mounted within the inner bore of a hollow mandrel 20, held in place by a nozzle retainer ring 52. The hollow mandrel 20 is in turn slidably mounted for reciprocal longitudinal movement within the inner bore of the top sub 12 and the inner bore of the upper housing 14.

The outer surface of the lower portion of the top sub 12 is sealed against the inner bore of the upper portion of the upper housing 14 by an O-ring seal 40. Similarly, the outer surface of the lower portion of the upper housing 14 is sealed against the inner bore of the upper portion of the lower housing 16 by an O-ring seal 44. Further, the outer surface of the upper portion of the hollow mandrel 20 is sealed against the inner bore of the lower portion of the top sub 12 by an O-ring seal 38. Still further, the outer surface of the lower portion of the hollow mandrel 20 is sealed against the inner bore of the upper housing 14 by an O-ring seal 42.

At least one bypass port 46 is provided in the upper housing 14, from the inner bore to the outer surface thereof. At least one mandrel port 50 is provided through the wall of the hollow mandrel 20. A multi-element high pressure seal 48 is provided around the periphery of the hollow mandrel 20, and within the inner bore of the upper housing 14, between the longitudinal locations of the bypass port 46 and the mandrel port 50, when the mandrel 20 is in the longitudinal position shown in FIG. 1. The high pressure seal 48 prevents premature leakage from the mandrel port 46 to the bypass port 50, along the outer surface of the mandrel 20.

A tubular spring sleeve 22 is slidably positioned in the inner bore of the upper housing 14, below the mandrel 20. The spring sleeve 22 encompasses the upper end of a minor spring 24, against which the lower end of the hollow mandrel 20 bears. A major spring 26 is positioned below the minor spring 24, within the inner bore of the upper housing 14 and the inner bore of the lower housing 16. The spring constant of the minor spring 24 is less than the spring constant of the major spring 26. This ensures that the minor spring 24 will compress before compression of the major spring 26 commences. The length of the spring sleeve 22 is less than the length of the minor spring 24, when the mandrel 20 is in its uppermost position as shown.

The spring constants of the minor and major springs 24, 26, and the length of the spring sleeve 22 are designed to ensure that the minor spring 24 will compress until the spring sleeve 22 establishes a compressive connection between the mandrel 20 and the major spring 26. During this compression of the minor spring 24, the mandrel port 50 is moving downwardly toward the bypass port 46. Thereafter, when the lower edge of the mandrel port 50 has reached the upper edge of the bypass port 46, compression of the major spring regulates the relative positions of the ports 46, 50, thereby regulating the amount of bypass flow of fluid to the annulus surrounding the upper housing 14. A longitudinal alignment groove 34 is provided in the outer surface of the mandrel 20, and a screw or alignment pin 36 protrudes from the upper housing 14 into the alignment groove 34, to maintain longitudinal alignment of the mandrel port 50 with its respective bypass port 46.

An upper spacer ring 28 is positioned between the lower end of the mandrel 20 and the upper ends of the spring sleeve 22 and the minor spring 24. An intermediate spacer ring 30 is positioned between the lower end of the minor spring 24 and the upper end of the major spring 26. One or more lower spacer rings 32 are positioned between the lower end of the major spring 26 and an abutting shoulder in the lower housing 16. The thicknesses of the spacer rings 28, 30, 32 establish the desired preloading of the minor and major springs 24, 26. These rings can be changed to control the desired amount of bypass flow for different total flow rates, thereby providing optimal fluid flow through the mud motor for all anticipated flow rates for a given application.

Figure 2:
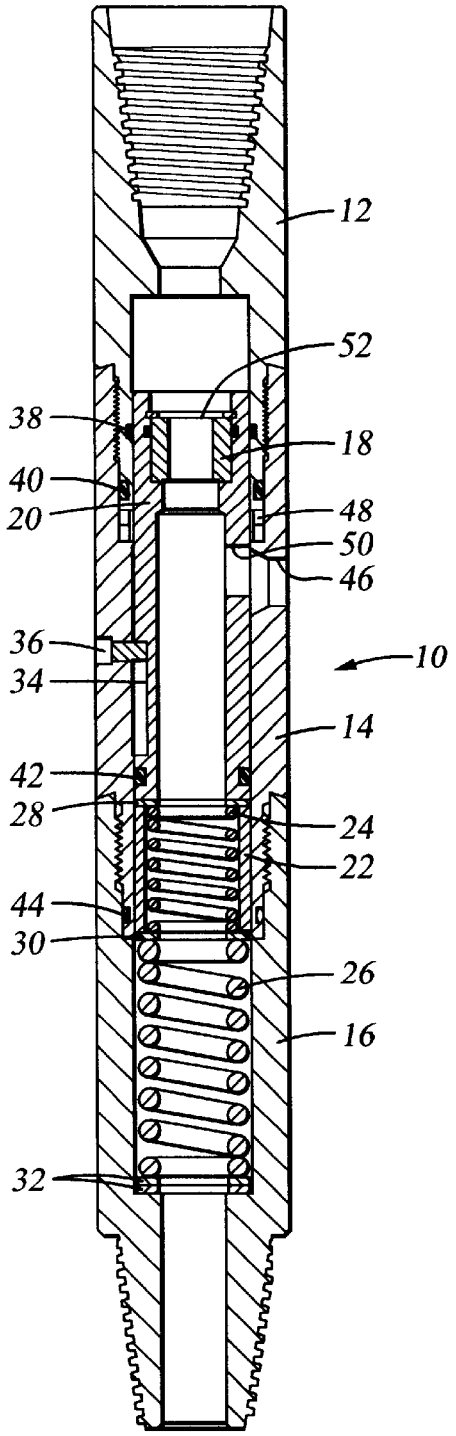
FIG. 2 is a longitudinal section view of the bypass sub of the present invention, showing the tool in the full bypass configuration.

FIG. 1 shows the mandrel 20 in its uppermost position, where no bypass flow is provided. FIG. 2 shows the mandrel at or near its most downward position, where maximum bypass flow is being provided. It can be seen that pump speed has been increased to increase the total fluid flow rate. This has increased the resistance in the nozzle 18, which has forced the mandrel 20 to compress the minor spring 24 until the spring sleeve 22 contacted the upper end of the major spring 26. Thereafter, further increased flow has compressed the major spring 26, until the mandrel port 50 has almost completely aligned with the bypass port 46. In the most downward position, further downward movement of the mandrel 20 will not result in increased bypass flow. With proper selection of the nozzle 18, the springs 24, 26, and the spacer rings 28, 30, 32, this maximum bypass flow rate will be sufficient to keep the cuttings in suspension.

It can be seen that, if total flow rate is decreased, the major spring 26 will push the mandrel 20 upwardly, partially closing the bypass port 46, thereby maintaining the optimal amount of fluid flow through the mud motor.

While the particular invention as herein shown and disclosed in detail is fully capable of obtaining the objects and providing the advantages hereinbefore stated, it is to be understood that this disclosure is merely illustrative of the presently preferred embodiments of the invention.

We claim:

1. A fluid bypass tool, comprising:

a tool body;

a flow control member within said tool body;

a fluid flow restriction within said flow control member;

a fluid passage from said upper end of said tool body, through said fluid flow restriction and said flow control member, to said lower end of said tool body;

a flow control port through a wall of said flow control member below said fluid flow restriction;

a bypass port through a wall of said tool body, said bypass port being positioned for fluid flow communication with said flow control port when said flow control member is in said lower position; and a biasing mechanism within said tool body, said biasing mechanism biasing said flow control member toward said upper position against downward force generated by fluid flow through said flow restriction;

wherein said flow control port is above said bypass port when said flow control member is in said upper position;

wherein said fluid flow restriction is oriented to generate a downward force on said flow control member proportional to the rate of fluid flow; and wherein said flow control member is constrained to move said flow control port into alignment with said bypass port with every downward movement of said flow control member.

2. A fluid bypass tool as recited in claim 1, wherein said flow control member comprises a hollow mandrel.

3. A fluid bypass tool as recited in claim 1, wherein said fluid flow restriction comprises a nozzle.

4. A fluid bypass tool as recited in claim 1, wherein said biasing mechanism comprises a spring.

5. A fluid bypass tool, comprising:

a tool body;

a hollow mandrel within said tool body;

a nozzle within said mandrel, said nozzle having a selected flow resistance;

a fluid passage from said upper end of said tool body, through said nozzle and said mandrel, to said lower end of said tool body;

a mandrel port through a wall of said mandrel below said nozzle;

a bypass port through a wall of said tool body, said bypass port being positioned for fluid flow communication with said mandrel port when said mandrel is in said lower position; and a spring mechanism within said tool body, said spring mechanism biasing said mandrel toward said upper position against downward force generated by fluid flow through said nozzle, said spring mechanism having a selected spring constant;

wherein said mandrel port is above said bypass port when said mandrel is in said upper position, and said mandrel port is in fluid flow communication with said bypass port when said mandrel is in said lower position;

wherein said nozzle is oriented to generate a downward force on said mandrel proportional to the rate of fluid flow; and wherein said mandrel is constrained to move said mandrel port into alignment with said bypass port with every downward movement of said mandrel.

6. A fluid bypass tool as recited in claim 5, wherein said flow resistance of said nozzle and said spring constant of said spring mechanism are selected to maintain a selected rate of fluid flow out said lower end of said tool body.

7. A fluid bypass tool as recited in claim 5, wherein said nozzle and said spring mechanism are adapted to move said mandrel vertically in response to changes in fluid flow rate through said nozzle.

8. A fluid bypass tool as recited in claim 5, wherein downward displacement of said mandrel compresses said spring mechanism.

9. A fluid bypass tool as recited in claim 5, wherein said spring mechanism comprises two springs, a first said spring having a first spring constant and a second said spring having a second spring constant, said first spring constant being lower than said second spring constant.

10. A fluid bypass tool as recited in claim 9, wherein:

said first spring is adapted to be compressed by movement of said mandrel before compression of said second spring; and wherein said spring mechanism further comprises a rigid body positioned between said mandrel and said second spring, said rigid body being adapted to contact said mandrel and said second spring, thereby initiating compression of said second spring by continued movement of said mandrel while preventing further compression of said first spring.

11. A fluid bypass tool as recited in claim 10, wherein said rigid body comprises a sleeve having a length equal to the desired minimum compressed length of said first spring.

12. A fluid bypass tool as recited in claim 9, wherein said first spring constant is selected to establish fluid flow communication between said mandrel port and said bypass port at a selected rate of fluid flow through said nozzle.

13. A fluid bypass tool as recited in claim 9, wherein said second spring is adapted to incrementally increase fluid flow out said bypass port in response to incremental increases in fluid flow rate through said nozzle.

* * * * *